United States Patent [19]

Bommaraju

[11] 4,456,518

[45] Jun. 26, 1984

[54] NOBLE METAL-COATED CATHODE

[75] Inventor: Tilak V. Bommaraju, Grand Island, N.Y.

[73] Assignee: Occidental Chemical Corporation, Niagara Falls, N.Y.

[21] Appl. No.: 332,908

[22] Filed: Dec. 21, 1981

Related U.S. Application Data

[63] Continuation-in-part of Ser. No. 287,013, Jul. 27, 1981, abandoned, which is a continuation-in-part of Ser. No. 148,320, May 9, 1980, abandoned.

[51] Int. Cl.[3] ..... C25B 11/00

[52] U.S. Cl. ..... 204/290 F; 204/290 R

[58] Field of Search ..... 204/290 F, 291, 292, 204/293, 290 R

[56] References Cited

U.S. PATENT DOCUMENTS

| | | | |
|---|---|---|---|
| 3,281,338 | 10/1966 | Leary et al. | 204/1.5 |
| 3,649,485 | 3/1972 | Chisholm | 204/95 |
| 3,992,271 | 11/1976 | Danzig et al. | 204/129 |
| 4,060,476 | 11/1977 | Treptow et al. | 204/290 K |
| 4,157,943 | 6/1979 | Scarpellino et al. | 204/37 R |
| 4,332,648 | 6/1982 | Spore | 204/95 |

FOREIGN PATENT DOCUMENTS

| | | | |
|---|---|---|---|
| 1056769 | 6/1979 | Canada | 204/290 F |
| 2658474 | 6/1978 | Fed. Rep. of Germany | 204/290 F |
| 1183770 | 3/1970 | United Kingdom | 204/290 F |

*Primary Examiner*—John F. Niebling

*Attorney, Agent, or Firm*—J. F. Tao; W. G. Gosz

[57] ABSTRACT

Cathodes comprising a conductive metal substrate, such as ferrous metal or titanium, having thereon an intermediate protective layer and an overcoating of a mixture of platinum and another noble metal are prepared. These cathodes function in aqueous alkali metal salt solution electrolytic cells or alkali metal halate electrolytic cells to reduce the cathode overvoltage in comparison with conventional ferrous metal electrodes.

6 Claims, No Drawings

NOBLE METAL-COATED CATHODE

CROSS-REFERENCE TO RELATED APPLICATIONS

This is a continuation-in-part of copending application Ser. No. 287,013, filed July 27, 1981 and now abandoned, which is a continuation-in-part-of copending application Ser. No. 148,320, filed May 9, 1980 and now abandoned.

BACKGROUND OF THE INVENTION

This invention relates to improved cathodes for use with electrolytic cells suited for the electrolysis of aqueous alkali metal salt solutions. More particularly, this invention relates to noble metal-coated electrodes having intermediate protective layers suitable for use as cathodes in electrolytic cells, enabling the cell to function more efficiently by reducing the cathode overvoltage.

The production of chlorine, hydrogen, chlorates, hydrochloric acids, and caustic solutions have been commercialized through the use of electrolytic processes. The electrolysis of alkali metal halide solutions has been undertaken for many years, with corresponding improvement in electrolytic cell design and manufacture. Mercury cells, diaphragm cells, membrane cells and specially designed cells have been employed extensively in the electrolysis of alkali metal halides. The electrolysis of alkali metal halides to produce alkali metal halates is accomplished in similar cells without diaphragms or membranes.

Each type of cell has advantages as well as disadvantages and each fits a specific industrial need, and such cells have been developed to a degree whereby high operating efficiencies have been obtained, and savings of energy, as well as increased useful life of the components of the electrolytic cells, have resulted. A common problem confronting the designers of the cells was the relatively limited life of the electrodes, especially anodes, due to their errosion or decomposition during cell operation. Consequently, great interest developed in anodes that would be free of the objectionable characteristics of the early graphite or carbon electrodes. Dimensionally stable anodes have been developed which have greatly overcome this problem. During the development of improved anodes for various electrolytic cells, minor attention had been given to the cathodes employed in the cells which traditionally have been composed of graphite, and later ferrous metals or titanium.

In an electrochemical cell, large quantities of electricity are used to conduct the reactions involved, and the savings of electricity, of whatever small amounts, is of great economic advantage to the operation of the cell. Therefore, the ability to effect savings in electricity in any step of the operation through cell operation, cell design or improvements in components is of utmost importance.

In terms of the actual voltages needed for the electrolytic reaction, the normal reversible potential for the reaction is increased by the values of the electrode potentials and ohmic drops. The increase in the value of the electrode potential over the normal reversible potential for the reaction is termed overvoltage. In other words, the difference between the electrode potential necessary for the flow of current and the equilibrium value of the electrode with no current flowing is the overvoltage of the electrode. Overvoltage is therefore related to such factors as the nature of the ion being discharged, the current density, the nature and surface structure of the electrode, the temperature, and the composition of the electrolyte. A great number of mechanisms have been proposed for the overvoltage-current density relationship at the electrodes. Overvoltage at the cathode in a chlor-alkali cell is due to the to the creation of the hydrogen atom and/or its subsequent formation into the hydrogen molecule. Cathode overvoltages can be reduced through the proper selection of materials, as it is well known that the hydrogen overvoltage is greatly dependent on the metal used for the electroactive surface.

Ideally a cathode should be constructed from materials that are inexpensive, easy to fabricate, mechanically strong and capable of withstanding the environmental conditions of an electrolytic cell. Iron or steel fulfills many of these requirements and has been the traditional material used since the advent of dimensionally stable anodes. When a chlor-alkali cell is bypassed or in an open circuit condition, the iron or steel cathodes become prone to electrolyte attack and their useful life is greatly reduced during this period. Metals more resistant to electrolyte attack than the iron or steel may be substituted, but usually are deficient in other characteristics. The overvoltage property of the metal is a major problem in these substitutions. Ferrous metal cathode have been used in commercial cells, but their overvoltage characteristics can be improved by replacing the iron with other metals, or by overcoating the iron with a high surface area electroactive material having lower overvoltage.

The use of noble metals has been investigated for cathode overvoltage reduction, and found to be quite beneficial, but due to the high cost of the metal, they have been avoided. U.S. Pat. No. 3,974,058, to Gokhale, issued Aug. 10, 1976, discloses a cathode for the electrolysis of alkali metal halide solutions comprising a metallic substrate, an intermediate layer of cobalt, and an overcoating of ruthenium. Similarly, Canadian Pat. No. 1,056,769, issued June 19, 1979, discloses that platinum-coated titanium cathodes have been employed in electrolytic cells, but have generally been found unsuitable due to excessive wear of the platinum coating. Other metals, such as cobalt and its alloys, and nickel and its alloys, reduce significantly the cathode overvoltage. These materials have been investigated and used, but the use of noble metals produces a more meaningful economic saving in the operation of chlor-alkali cells.

In a typical diaphragm type cell for the production of chlorine, the metal cathodes have been of a woven wire mesh construction. This woven wire mesh is most conveniently constructed from a ferrous metal. More recently, the cathodes have been manufactured in a foraminous form from a perforated and/or expanded metal sheet.

U.S. Pat. No. 3,859,196 by Ruthel et al., issued Jan. 7, 1975, is cited herein to show the state of the art. Attempts to use these ferrous metal configurations as a base material followed by overcoating with an improved surface having lower cathode overvoltage properties have been investigated. Improvements in current efficiency have been attained by the incorporation of noble metals into these cathode structures, but the techniques of manufacture, poor adherence of the coating to the substrate, and high material costs have negated their adoption. The present invention provides a procedure for the production of cathodes, suitable for use in electrolytic chlor-alkali or chlorate cells, that are economical to prepare, have good durability, and have reduced cathode overvoltages. Any of the foregoing ferrous metal configurations are suitable for purposes of this invention.

SUMMARY OF THE INVENTION

In accordance with the present invention, there is provided a cathode and method for the manufacture of a cathode coated with a mixture of platinum and another noble metal. When used in a chlorate cell, intermediate layers comprising silver, copper, intermetallic compounds of titanium with transition metals or noble metals, titanium carbides, borides, nitrides, silicides, phosphides, sulfides, and fluorides are all suitably employed. Such cathodes provide significant voltage savings and the capability of operating at high current densities. Furthermore, the present method provides a thermal technique for preparing a noble metal coating on an inexpensive base material for use as a cathode in a chlor-alkali or chlorate cell, and a cathode which will withstand the operating conditions of the cell, as well as reducing the hydrogen overvoltage of the cell, and which will provide for the operation of the cell in a more efficient manner.

DESCRIPTION OF THE PREFERRED EMBODIMENTS OF THE INVENTION

The use of noble metals as cathode surfaces provides excellent resistance to chemical attack and deterioration; but due to the expense of manufacturing the entire cathode structure from a noble metal, this has been avoided. It is therefore preferred to use as a base material, a more inexpensive metal such as iron, steel, graphite or titanium, which can be easily fabricated, and to overcoat the base metal with a mixture of platinum and another noble metal in order to provide the desired structure and surface characteristics.

The noble metals which are suitable for use in this application include ruthenium, rhodium, palladium, iridium, and osmium, with palladium and iridium being especially preferred. Generally, platinum is the major metallic component of the coating, present in an amount of at least about 50% by weight of total metal components in the coating, with preferred coatings containing from about 50% to about 95% by weight. When used in the present specification and claims, the term "noble metal" denotes any of the above-mentioned metals, as well as compounds thereof, such as their corresponding oxides, sulfides, or phosphides, present either in complex or simple chemical formulations.

Due to the complex configuration used for the cathode structure, conventional overcoating techniques, such as electroplating, or other chemical means of depositing noble metals onto the structure, can be extremely difficult, as well as expensive and wasteful. It is, therefore, desirable to develop a system whereby selected cathode surfaces can be easily coated with a porous, inexpensive coating having a high, electrochemically active surface area.

Degradation of cathode materials during electrolysis can occur by either corrosion under open circuit conditions due to hypochlorite or hydrogen ion reduction in the case of iron-based materials, or by hydriding in the case of titanium-based materials. This will adversely affect the operation of the cell when the cathode is placed into later use. Thus, it is advantageous to provide an intermediate coating between the noble metal coating and the cathode substrate to protect the substrate and to provide improved bonding between the noble metal coating and the cathode. It has been found particularly advantageous to provide an intermediate coating selected from the group consisting of silver, copper, intermetallic compounds of titanium with transition metals or noble metals, titanium carbides, borides, nitrides, silicides, phosphides, sulfides, and fluorides. "Transition metal", in the context of the present invention, includes iron, cobalt, and nickel. The intermediate coating can be electrodeposited onto the cathode substrate, which has been suitably cleaned to remove traces of oil, and roughened to improve bonding of the intermediate coating. Other techniques which are suitable for applying the intermediate coating include termal decomposition and chemical vapor deposition. Particularly suitable techniques include vacuum coating processes such as vacuum evaporation, vacuum sputter deposition, and ion plating, which are well known coating techniques in the metallurgical and related sciences. The thickness of the intermediate coating can range from about 1 micron to about 1000 microns.

The noble metal layer can then be deposited directly onto the intermediate surface by applying a noble metal-containing paint which is decomposed by heat, leaving a noble metal surface which will function as a cathode in an electrolytic cell. Although thermal deposition is the preferred technique for applying the noble metal coating due to ease of application and lower cost, other suitable techniques which provide a high surface area, porour coating, such as electrodeposition, can also be used.

Platinum metal paints which decompose upon heating to form metallic surfaces are well known to the art as decorating paints for glass, ceramics, metals and other refractory substrates. Decorating compositions containing platinum have been described by Chemnitius, J. Soc. Glass Tech. 13, 59 (1930); C.A. 24, 4909. Such compositions contain a platinum resinate prepared by causing a platinum salt to react with a sulfurized terpene. The platinum reinate is dissolved in a vehicle and may be mixed with fluxing material to form decorating compositions.

A typical procedure for the preparation of a suitable paint composition is as follows: 89 grams of Canadian Balsam is mixed and heated with 11 grams of sulfur at approximately 180° C. for two to three hours to obtain sulfonated balsam. This sulfonated balsam is allowed to cool to room temperature, and 20 milliliters of ethyl ether and 20 milliliters of oil of turpentine are added to obtain a solution. To this is added an ethyl ether solution of a platinum salt, such as platinum chloride, and an ethyl ether of another noble metal salt, preferably a palladium or iridium salt, and the paint is uniformly mixed. The total noble metal content in the paint should be in the range of about 7–10% by weight. This paint can be applied to the silver-coated substrate by conventional means, such as brushing or spraying, in order to obtain uniform coverage of the desired area.

The use of a palladium or iridium salt in the paint in combination with the platinum salt is effective to improve the smooth deposition of the platinum onto the cathode, and to improve the adherence or bonding of the coating to the substrate. It has been found that a deposit of platinum metal alone does not have sufficient adherence to the substrate to demonstrate the durability required in a commercial cathode (c.f. Canadian Pat. No. 1,056,769).

This paint can then be applied in a uniform layer to the substrate, and dried in air to a non-tacky finish. The coated substrate is then heated or fired at about 500° Centigrade, for about 10–20 minutes. After firing, a deposit of noble metal is obtained on the surface which can now function effectively as a cathode in a chlor-alkali or chlorate cell.

The baking or firing may be done at higher temperatures, but it has been found that if the temperature is raised to 800° C., the platinum will be obtained as a bright film; and the oxidation of the base material is accelerated at this temperature, which is therefore not advised for the preparation of the platinized cathode.

The preferred heating or baking cycle ranges from about 100° C. to about 600° C., and the time period for such baking should preferably be in the region of about 10–20 minutes. The purpose of the heating or baking cycle is to decompose organic compounds present to yield a thin film of predominating platinum metal on the substrate. Depending upon the thickness of metal desired, multiple coatings may be necessary in order to obtain the desired thickness. It is unnecessary to bake each coating after application, but the multiple coatings should be air dried before application of the next coating; and then after multiple paintings, one firing will suffice for the conversion of the entire thickness of the paint to the metal. It has been found that the application of three coats of the paint, followed by firing within the specified temperature range, produces a film having an average thickness of approximately 3 micrometers. A film of this thickness is not necessarily the desired thickness for cathode preparation, but is merely noted to indicate the thickness of the metal layer obtained.

Since noble metals have been found to be very active as hydrogen electrodes, only a thin deposit of metal deposited on the substrate is needed to minimize the hydrogen overvoltage. However, it may be necessary to repeat the painting operation in order to obtain uniformity in the deposited platinum layer, which would affect the efficiency of the cell. By way of illustration, for a chlorate cell cathode having a platinum/iridium surface, a metal loading in the range of from about 0.1 mg./cm$^2$ to about 10 mg./cm.$^2$ is satisfactory.

The electroactive surface need not be applied to the entire surface area of the cathode structure, but may be selectively applied to the desired portions dependent upon the type of cell in which the cathode is to be positioned and where the electroactive surface is desired relative to positioning of the cathode, anode, diaphragm and/or separator in the cell. Although normally the electroactive surface would be uniformly applied, the ease of application of the paint provides for selective coating of the substrate as well as providing the ability to control the thickness of the noble metal coating on the desired areas of the cathode.

It has been found beneficial to include another noble metal in the coating in combination with platinum, to improve both the deposition of the coating and the mechanical bonding of the coating to the base material. Such mixtures of platinum and another noble metal can be conveniently prepared by substituting the other noble metal for a portion of the platinum in the paint composition desscribed above. Especially preferred noble metals include palladium and iridium; a platinum/palladium coating being particularly suited for chlor-alkali applications, while a platinum/pyridium coating is particularly suited for chlorate applications. Such a platinum/palladium or platinum/iridium coating may be a physical mixture, an alloy, or an intermetallic compound of the metals, depending on the specific conditions used in the coating procedure. However, it is to be understood that any such combination of metals that procudes an electroactive surface is within the purview of this invention. Minor amounts of bismuth and/or antimony can also be added to the noble metal coating to promote adhesion to the substrate.

The following are examples of the preparation of a cathode having a platinum/iridium surface specially intended for use in a chlorate cell:

EXAMPLE 1

A titanium sheet (ASTM Grade 1) was degreased, sandblasted, cleaned in trichloroethylene for 1 hour at 80° C., and coated with a thin layer of silver by electrodeposition. Following a thermal treatment at 150° C. for 10 minutes, the hot sample was sprayed with a mixture comprising 70% chloroplatinic acid and 30% chloriridic acid dissolved in isopropyl alcohol, and subjected to thermal decomposition in an oven at 150° C. After repeating the procedure 10 times, a final thermal treatment was employed at 550° C. for 10 minutes.

This material, when used as a cathode for electrolysis of a chlorate solution containing 350 g/l. $NaClO_3$; 150 g/l. NaCl; 4–5 g/l. NaOCl; and 2.5 g/l. $Na_2Cr_2O_7$, at a temperature of 70° C., a pH of about 5–7, and a current density of 1.5 ASI, exhibited a voltage decrease of 300 to 350 mv., as compared to a chlorate cell employing a conventional steel cathode.

EXAMPLE 2

Four titanium cathodes were cleaned with perchloroethylene and methanol, etched in a solution of 10% oxalic acid in water maintained at 90° C. to 95° C. for one hour, rinsed with deionized water and methanol and air dired. The cleaned cathode surfaces were coated by vacuum sputter coating with 1 micrometer of titanium nitride, followed by a 0.2 micrometer coating of platinum also applied by vacuum sputter coating.

The cathodes were used to electrolyze a 300 g/l. NaCl electrolyte in a chlorate cell. The anodes used in the chlorate cell were titanium plates coated with a Pt/Ir alloy containing 70% Pt and 30% Ir. Three such anodes were used in the cell and placed between two adjacent cathodes. The cell was operated for 40 days at 70° C.

After 40 days of operation, the cathodes were removed and visually inspected. The distortion of the cathodes appeared minimal or close to zero. Sections were cut from two of the cathodes and examined metallographically. No hydride layer was visible. Similarly, no hydride layer was found upon X-ray diffraction.

Following a similar procedure, cathodes were prepared by coating titanium sheets with an intermetallic compound of $RuO_2/TiO_2$, followed by a surface coating of 70% Pt/30% Ir. Examination of these cathodes showed a titanium hydride coating of 4–10 mils (0.0004–0.010 inches) after similar testing.

A cathode prepared according to the present invention, upon operation in a chlor-alkali or chlorate cell, has a reduced hydrogen overvoltage relative to a conventional iron or steel cathode. The reduction of the overvoltage will improve the energy efficiency of the cell, as the overvoltage reduction will mean an economic savings to the operator of the cell.

Cathodes prepared with a noble metal coating have applications in many types of cells. The cathode portion of bipolar electrodes may be easily constructed using this technique as the coating may be applied to specific surfaces, in specific design areas, as well as to a variety of substrate materials in order to provide the properties obtainable through the use of noble metal active surfaces.

The foregoing examples have been described in this specification for the purpose of illustration, and not limitation. Many other modifications and ramifications will naturally suggest themselves to those skilled in the art based on this disclosure. These are intended to be within the full intended scope of this invention as defined by the appended claims.

What is claimed is:

1. A low hydrogen overvoltage alkali metal halate cell cathode comprising a conductive substrate, an intermediate protective layer selected from the group consisting of copper, intermetallic compounds of titanium with noble metals, intermetallic compounds of titanium with transition metals, titanium carbides, titanium borides, titanium nitrides, titanium silicides, titanium phosphides, titanium sulfides, and titanium fluorides, and a porous noble metal coating adhered to and extending over at least a portion of the protective layer, a major portion of said noble metal coating comprising platinum, and a minor portion of said noble metal coating comprising a second noble metal selected from the group consisting of rhodium, palladium, iridium and osmium.

2. The cathode of claim 1 wherein the platinum is present in the coating in an amount of from about 50% to about 95% by weight of metal components in the coating.

3. The cathode of claim 1 wherein the substrate is titanium or an alloy thereof and the second noble metal is iridium.

4. The cathode of claim 3 wherein the noble metal layer has a metal loading in the range of from about 0.1 mg./cm$^2$ to about 10 mg./cm$^2$.

5. The cathode of claim 1 wherein the intermediate protective layer is titanium nitride, and the second noble metal is iridium.

6. The cathode of claim 1 wherein the porous noble metal coating includes a minor amount of bismuth and/or antimony.

* * * * *